US010753256B2

(12) United States Patent
Takemoto et al.

(10) Patent No.: US 10,753,256 B2
(45) Date of Patent: Aug. 25, 2020

(54) INJECTION CONTROLLER

(71) Applicant: DENSO CORPORATION, Kariya, Aichi-pref. (JP)

(72) Inventors: Eiji Takemoto, Kariya (JP); Tomomi Oshima, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/239,693

(22) Filed: Jan. 4, 2019

(65) Prior Publication Data

US 2019/0211727 A1 Jul. 11, 2019

(30) Foreign Application Priority Data

Jan. 9, 2018 (JP) ..... 2018-001298

(51) Int. Cl.
*F01N 9/00* (2006.01)
*F01N 3/20* (2006.01)
(Continued)

(52) U.S. Cl.
CPC ..... *F01N 3/208* (2013.01); *F01N 3/035* (2013.01); *F01N 3/04* (2013.01); *F01N 3/05* (2013.01); *F01N 3/2066* (2013.01); *F01N 3/225* (2013.01); *F01N 3/323* (2013.01); *F01N 9/00* (2013.01); *F01N 13/009* (2014.06); *F01N 2250/02* (2013.01); *F01N 2610/02* (2013.01); *F01N 2610/144* (2013.01); *F01N 2610/146* (2013.01); *F01N 2610/1446* (2013.01); *F01N 2610/1473* (2013.01)

(58) Field of Classification Search
CPC ..... F01N 3/206; F01N 3/2066; F01N 3/208; F01N 2610/02; F01N 2610/1433; F01N 2610/144; F01N 2900/1822
See application file for complete search history.

(56) References Cited

U.S. PATENT DOCUMENTS

2013/0032214 A1* 2/2013 Saby ..... B01D 19/0031 137/1
2013/0111882 A1* 5/2013 Eriksson ..... F01N 3/2066 60/274
2019/0226376 A1* 7/2019 Siedenberg ..... F01N 3/208

FOREIGN PATENT DOCUMENTS

JP 2011157925 A * 8/2011 ..... F02D 41/22
JP 5338696 11/2013

OTHER PUBLICATIONS

Machine translation of JP 2011-157925A, accessed Jan. 31, 2020. (Year: 2020).*

* cited by examiner

*Primary Examiner* — Jonathan R Matthias
(74) *Attorney, Agent, or Firm* — Nixon & Vanderhye, P.C.

(57) ABSTRACT

An injection controller that is applied to an exhaust purification system including an injector that is located in an exhaust passage of an internal combustion engine and injects to supply a reducing agent in a liquid state to a NOx purification catalyst purifying NOx in an exhaust gas, and a pump that pressurizes and pumps the reducing agent to the injector through a reducing-agent passage. The injection controller includes an acquisition unit configured to acquire a variation quantity of a rotational speed of the pump caused in response to an injection of the injector or a correlation value that is a value correlative to the variation quantity, as a rotational variation parameter, and a determination unit configured to determine whether an air mixing exists in the reducing-agent passage based on the rotational variation parameter.

7 Claims, 7 Drawing Sheets

(51) Int. Cl.

| | |
|---|---|
| ***F01N 13/00*** | (2010.01) |
| ***F01N 3/035*** | (2006.01) |
| ***F01N 3/04*** | (2006.01) |
| ***F01N 3/05*** | (2006.01) |
| ***F01N 3/22*** | (2006.01) |
| ***F01N 3/32*** | (2006.01) |

INJECTION CONTROLLER

CROSS REFERENCE TO RELATED APPLICATION

This application is based on Japanese Patent Application No. 2018-1298 filed on Jan. 9, 2018, the disclosure of which is incorporated herein by reference.

TECHNICAL FIELD

The present disclosure relates to an injection controller which determines whether air enters a reducing-agent passage in an exhaust purification system including an injector, the reducing-agent passage and a pump.

BACKGROUND

Recently, in an engine applied to a vehicle such as a diesel engine, a urea selective catalytic reduction system (urea SCR system) is developed and produced as an exhaust purification system that purifies nitrogen oxides (NOx) in an exhaust gas with a high purification rate.

The urea SCR system includes a pump that pumps a urea water stored in a tank as a reducing agent to a reducing-agent passage, and a injector that injects the urea water pumped through the reducing-agent passage into an exhaust pipe of the engine.

In the urea SCR system, the exhaust gas is purified by a reduction reaction of NOx at a NOx purification catalyst that is a SCR catalyst in the exhaust pipe. In the reduction reaction of NOx, the urea water injected from the injector into the exhaust pipe is hydrolyzed by an exhaust-gas heat to generate ammonia (NH3), and the ammonia is adsorbed at the SCR catalyst. The NOx in the exhaust gas is reduced at the SCR catalyst by a reduction reaction executed by the ammonia, to be purified.

In the urea SCR system, air may enter the reducing-agent passage. In other words, an air mixing may exist in the reducing-agent passage. For example, in the urea SCR system, a draw and return processing is executed to draw and return the urea water in the reducing-agent passage to the tank to maintain the urea water not to be frozen in the reducing-agent passage when the engine is stopped. Thus, in the urea SCR system, the reducing-agent passage is filled with the urea water when the engine starts. In this case, the air may enter the reducing-agent passage. When the air enters the reducing-agent passage, an injection quantity of the urea water injected from the injector to the exhaust pipe becomes unstable.

JP5338696B2 discloses a technology to detect whether the air enters a fuel passage from a fuel pressure in the fuel passage. By applying the technology to the urea SCR system, it can be determined whether the air mixing exists in the reducing-agent passage from a pressure of the urea water in the reducing-agent passage.

SUMMARY

According to the technology in JP5338696B2, it is determined whether the air mixing exists in the reducing-agent passage from the pressure of the urea water in the reducing-agent passage. Thus, when the pressure of the urea water in the reducing-agent passage is maintained to be constant by a pressure feedback control, it cannot be determined whether the air mixing exists in the reducing-agent passage from the pressure of the urea water in the reducing-agent passage with a high precision. A technology is requested to appropriately determine whether the air mixing exists in the reducing-agent passage. The above matter is not limited to the urea water, and it is a common matter for a case where other liquid is used as a reducing agent.

It is an object of the present disclosure to provide an injection controller which can appropriately detect whether air exists in a reducing-agent passage.

According to an aspect of the present disclosure, the injection controller is applied to an exhaust purification system including an injector that is located in an exhaust passage of an internal combustion engine and injects to supply a reducing agent in a liquid state to a NOx purification catalyst purifying NOx in an exhaust gas, and a pump that pressurizes and pumps the reducing agent to the injector through a reducing-agent passage. The injection controller includes an acquisition unit configured to acquire a variation quantity of a rotational speed of the pump caused in response to an injection of the injector or a correlation value that is a value correlative to the variation quantity, as a rotational variation parameter, and a determination unit configured to determine whether an air mixing exists in the reducing-agent passage based on the rotational variation parameter.

When the injector supplied the reducing agent to the exhaust pipe, the pressure in the reducing-agent passage varies. When the pressure in the reducing-agent passage varies, a pump rotational speed varies. When the air enters the reducing-agent passage, the variation quantity of the pump rotational speed becomes greater by an elastic deformation of the air in response to a pressure variation in the reducing-agent passage comparing with a case where the air does not enter the reducing-agent passage. In other words, since the variation quantity of the pump rotational speed and an air quantity that is a quantity of the air entered the reducing-agent passage have a correlation, it can be appropriately determined whether the air mixing exists in the reducing-agent passage based on the variation quantity of the pump rotational quantity.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

First Embodiment

Hereafter, an exhaust purification system 10 to which a pump control unit 70 associating with an injection controller according to a first embodiment of the present disclosure is applied will be described referring to drawings. The exhaust purification system 10 purifies NOx in an exhaust gas by using a selective catalytic reduction catalyst (SCR catalyst), and is constituted as a urea SCR system. The exhaust purification system 10 can be applied to various vehicles where a diesel engine 30 that is an internal combustion engine is mounted to. According to the present embodiment, the diesel engine 30 is referred to as an engine 30. The exhaust purification system 10 can also be applied to a construction machine such as a crane truck and an agricultural machine such as a tractor.

Figure 1:
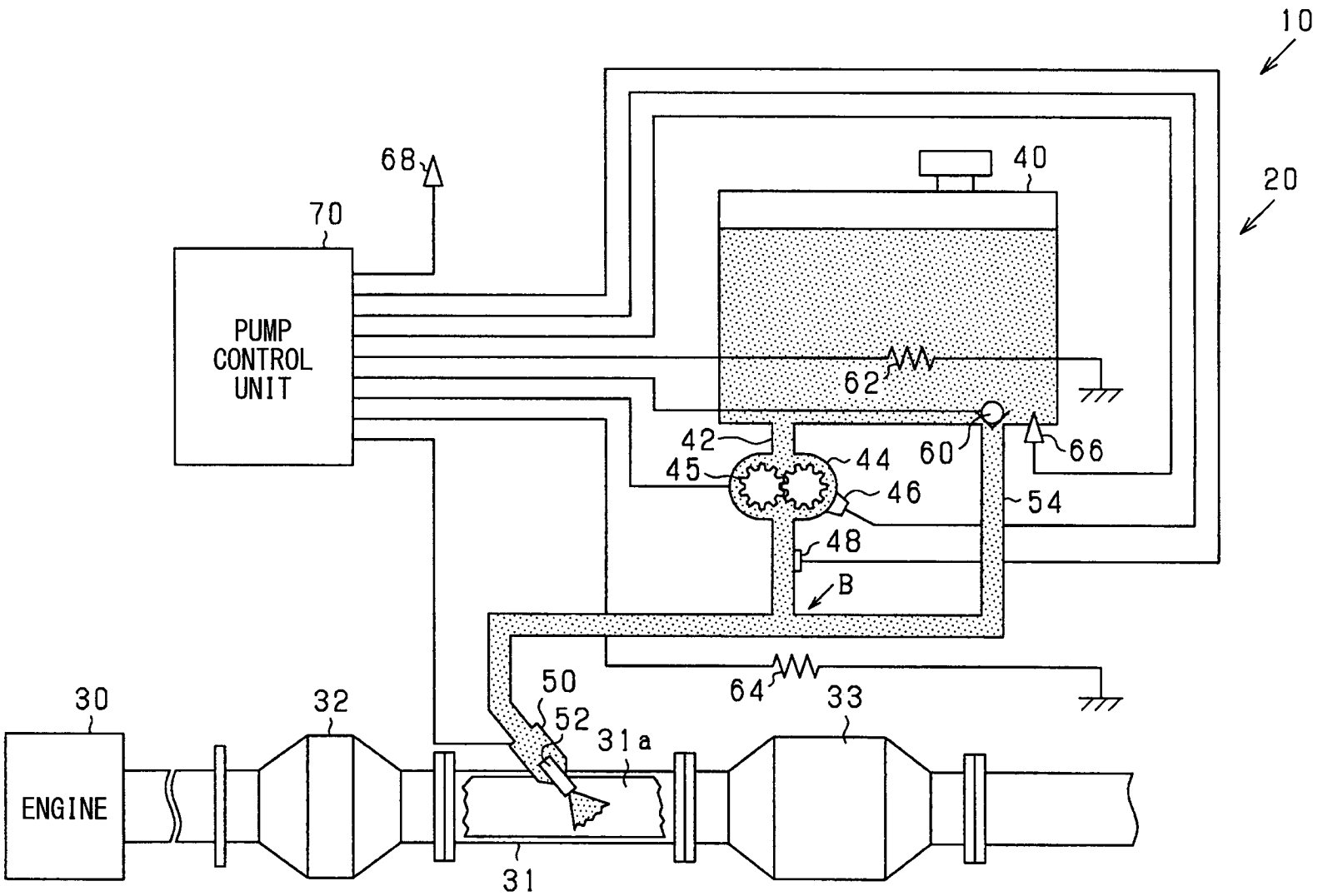
FIG. 1 is a schematic diagram showing an outline of an exhaust purification system of an engine.

As shown in FIG. 1, the exhaust purification system 10 includes an engine exhaust system. In the engine exhaust system, an exhaust pipe 31 defining an exhaust passage 31*a* is connected with the engine 30. A diesel particulate filter (DPF) 32 and the SCR catalyst 33 are arranged in the exhaust pipe 31 from an upstream end of the exhaust pipe 31 in this order.

A urea-water injector 50 that injects to supply a urea water to the exhaust passage 31*a* is located at a position in the exhaust pipe 31 between the DPF 32 and the SCR catalyst 33. In this case, the urea water that is a reducing agent is in a liquid state, and is also a urea water solution. According to the present embodiment, the urea-water injector 50 is referred to as an injector 50. The injector 50 is attached to only arrange a tip end part of the injector 50 in the exhaust pipe 31, so as to prevent an influence of heat from the exhaust gas that is in a high temperature such as 600 degrees Celsius. According to the present embodiment, the SCR catalyst 33 is equivalent to a NOx purification catalyst.

The DPF 32 is a filter that collects particulate matter (PM) in the exhaust gas to remove the PM. The DPF 32 supports an oxidation catalyst of a platinum group, and removes a soluble organic fraction (SOF) that is one component of the PM, HC and CO. The PM collected by the DPF 32 can be removed by a combustion caused by a post injection after a main injection in the engine 30. Thus, the DPF 32 can be continuously used.

The SCR catalyst 33 promotes a reduction reaction of NOx that is an exhaust purification reaction. For example, the SCR catalyst 33 purifies NOx in the exhaust gas by promoting reactions indicated by formulas (1), (2) and (3).

$$4NO+4NH_3+O_2 \rightarrow 4N_2+6H_2O. \quad (1)$$

$$6NO_2+8NH_3 \rightarrow 7N_2+12H_2O. \quad (2)$$

$$NO+NO_2+2NH_3 \rightarrow 2N_2+3H_2O. \quad (3)$$

The injector 50 located at a position upstream of the SCR catalyst 33 injects to supply the urea water to generate an ammonia ($NH_3$) that is a reducing agent of the NOx in the above reactions.

An oxidation catalyst as an ammonia removing device may be located at a position in the exhaust pipe 31 downstream of the SCR catalyst 33. In this case, the oxidation catalyst removes a surplus ammonia that is the ammonia discharged from the SCR catalyst 33.

Next, a constitution of a reducing-agent injection system 20 in the exhaust purification system 10 will be described. The reducing-agent injection system 20 injects the urea water by an injection of the injector 50. According to the present embodiment, when the urea water is supplied from a urea water tank 40 of the exhaust purification system 10 to the injector 50, a region close to the urea water tank 40 is referred to as an upstream region and a region close to the injector 50 is referred to as a downstream region. Further, the urea water tank 40 is referred to as a tank 40.

As shown in FIG. 1, the tank 40 is constituted by a sealed container having a supply cap. The tank 40 stores the urea water with a normal concentration that is predetermined. According to the present embodiment, a urea water concentration that is a concentration of the urea water is 32.5% that is a concentration where a freezing point is lowest. When the urea water is 32.5%, the urea water is frozen at −11 degrees Celsius.

The tank 40 and the injector 50 are connected with each other through a supply pipe 42. The supply pipe 42 includes an upstream end part that is connected with a bottom surface of the tank 40. The urea water stored in the tank 40 flows into the supply pipe 42. According to the present embodiment, the supply pipe 42 is equivalent to a reducing-agent passage.

A urea water pump 44 that is referred to as a pump 44 is located in the supply pipe 42. The pump 44 is an electric pump that is rotational driven by a current supplied from the pump control unit 70. The pump 44 pressurizes and pumps the urea water to the injector 50 through the supply pipe 42.

The pump 44 includes a gear 45. The pump 44 supplies the urea water in response to a rotational speed of the gear 45. In the pump 44, the gear 45 can rotate in a normal direction and in an inverse direction. Hereafter, when the gear 45 rotates in the normal direction, the pump 44 is in a normal rotation. When the gear 45 rotates in the inverse direction, the pump 44 is in an inverse rotation. A drawing of the urea water from the tank 40 is executed by the normal rotation of the pump 44, and a returning of the urea water to the tank 40 is executed by the inverse rotation of the pump 44.

A rotation detection unit 46 is attached to the pump 44. The rotation detection unit 46 detects a rotational speed N that is a rotational number of the pump 44 per unit time. For example, the rotation detection unit 46 detects a discharge speed that is a pumping speed of the urea water caused by the pump 44.

A pressure detection unit 48 is located in the supply pipe 42 downstream of the pump 44. The pressure detection unit 48 detects a pipe pressure P that is a pressure in the supply pipe 42. For example, the pressure detection unit 48 detects a discharge pressure of the urea water caused by the pump 44. According to the present embodiment, the pressure detection unit 48 is equivalent to the pressure detection unit.

The injector 50 is connected with a downstream end part of the supply pipe 42. The injector 50 is an injector having a constitution substantially the same as a known injector. The injector 50 that is an electromagnetic on-off valve includes a driving unit having an electromagnetic solenoid, and a valve body unit having a needle 52 that opens and closes an injection port that is located at a tip end of the injector 50. The injector 50 opens and closes based on a drive signal Sm transmitted from the pump control unit 70. In other words, when the electromagnetic solenoid is energized based on the drive signal Sm, the needle 52 moves in a valve-opening direction in response to an energization of the electromagnetic solenoid, and the injection port is opened by a movement of the needle 52 and the urea water is injected.

An air releasing pipe 54 is connected with the supply pipe 42. The air releasing pipe 54 is connected with a branch part B in the supply pipe 42 downstream of the pump 44 and is connected with the tank 40. The pressure detection unit 48 is located in the supply pipe 42 between the pump 44 and the branch part B. According to the present embodiment, the air releasing pipe 54 is equivalent to an air releasing passage.

Figure 8:
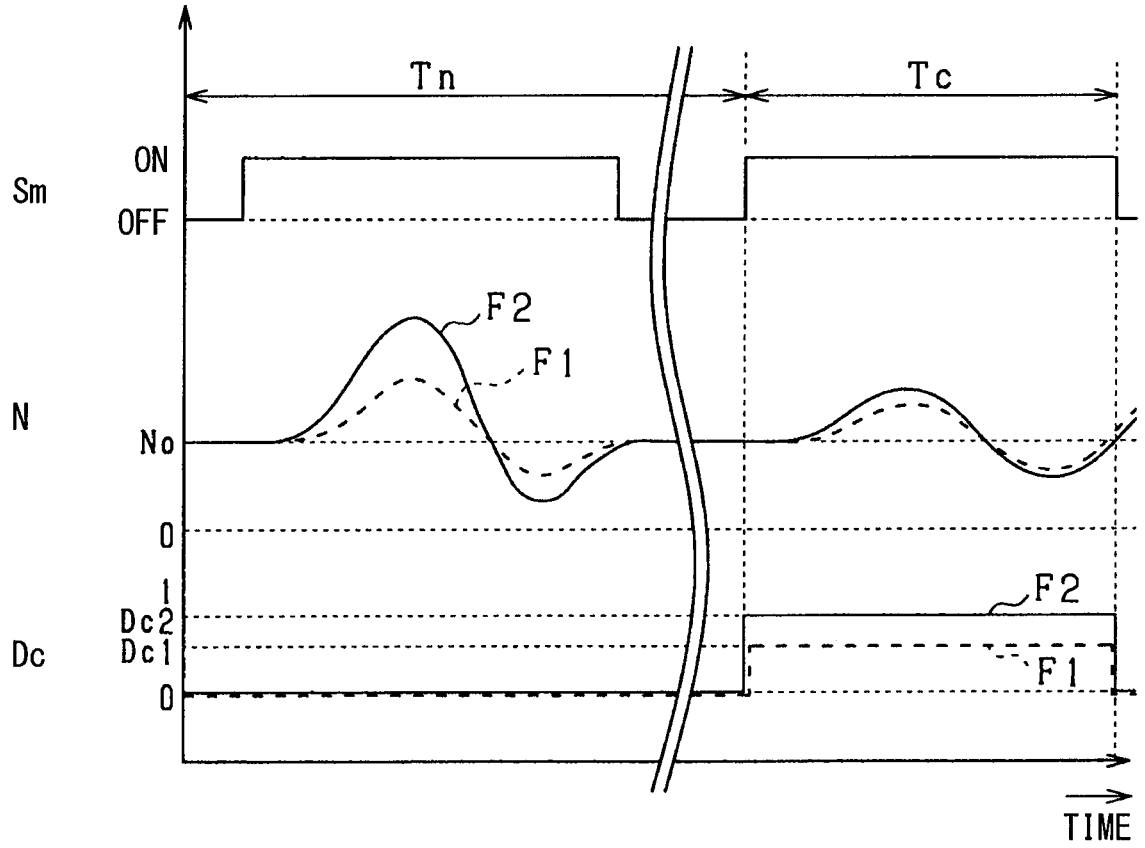
FIG. 8 is a graph showing a setting of the collection duty ratio.

The air releasing pipe 54 includes an end that communicates with the tank 40 at the surface of the tank 40. An air releasing valve 60 is located at the end of the air releasing pipe 54. The air releasing valve 60 opens and closes the air releasing pipe 54 based on a control signal Sc transmitted from the pump control unit 70. Hereafter, a time period where the control signal Sc is input to the air releasing valve 60 is referred to as a control time period Tc as shown in FIG. 8. In the control time period Tc, when the air releasing valve 60 is opened based on the control signal Sc, the urea water flowing from the supply pipe 42 to the air releasing pipe 54 is returned (attracted) to the tank 40.

The air releasing valve 60 also functions as a check valve in a control stop time period Tn where the control signal Sc is not input from the pump control unit 70 as shown in FIG. 8. In the control stop time period Tn, the air releasing valve 60 is opened in response to a pressure in the air releasing pipe 54 which is greater than a predetermined pressure, and the air releasing valve 60 is closed in response to the pressure in the air releasing pipe 54 which is less than the predetermined pressure.

A first heating element 62 is located in the tank 40. The first heating element 62, for example, is a heater of an electric type. The first heating element 62 thaws out the urea water which is frozen in the tank 40 by being energized based on an instruction signal transmitted from the pump control unit 70. It is preferable that the first heating element 62 is arranged at a position where the first heating element 62 can thaw out the urea water which is frozen. Specifically, the first heating element 62 may be located in the vicinity of an inlet of the supply pipe 42.

A second heating element 64 is located in the vicinity of an outer periphery of the supply pipe 42. The second heating element 64, for example, is a heater of an electric type. The second heating element 64 thaws out the urea water which is frozen in the supply pipe 42 by being energized based on an instruction signal transmitted from the pump control unit 70.

A temperature sensor 66 is located in the tank 40. The temperature sensor 66, for example, is a temperature-sensitive diode or a thermistor. The temperature sensor 66 detects a temperature of the urea water in the tank 40. An ambient temperature sensor 68 is located at a position outside of the tank 40. The ambient temperature sensor 68, for example, is a temperature-sensitive diode or a thermistor. The ambient temperature sensor 68 is located at a position that is separated from the tank 40, and detects an ambient temperature around a vehicle where the engine 30 is mounted to.

The pump control unit 70 is an electronic control unit (ECU) that executes a control relating to an exhaust purification. The pump control unit 70 is constituted by a microcomputer including a CPU, a ROM, a RAM and an input-output interface.

The pump control unit 70 acquires the rotational speed N from the rotation detection unit 46, acquires the pipe pressure P from the pressure detection unit 48, acquires the temperature of the urea water in the tank 40 from the temperature sensor 66, and acquires the ambient temperature from the ambient temperature sensor 68. The pump control unit 70 controls various components of the reducing-agent injection system 20 by values that are acquired.

Specifically, when the urea water is pumped toward the injector 50, the pump 44 is rotatably driven in a normal rotational direction by being energized. Thus, the urea water in the tank 40 is drawn to flow toward downstream. The pump 44 pumps the urea water to supply the urea water to the injector 50. The surplus urea water is returned to the tank 40 through the air releasing valve 60.

When the urea water is returned to the tank 40, the pump 44 is rotatably driven in an inverse rotational direction. Thus, the urea water in the supply pipe 42 is attracted to the tank 40. It is prevented that the urea water is still left in the supply pipe 42 when the vehicle is parked after the engine 30 is stopped, and a damage of the supply pipe 42 caused by a freezing or an expansion of the urea water is suppressed.

In a case where the vehicle is parked while the urea water in the supply pipe 42 is returned to the tank 40 after the engine 30 is stopped, the supply pipe 42 is filled with the urea water when the engine 30 starts. In this case, the air Ar being a bubble shape enters the supply pipe 42 as shown in FIGS. 5A, 5B, 5C and 5D. When the air Ar enters the supply pipe 42, it is possible that an injection quantity of the urea water injected by the injector 50 to be supplied to the exhaust passage 31*a* becomes unstable.

Specifically, when the injector 50 injects the urea water, the pipe pressure P varies. To correct a pressure variation of the pipe pressure P, the rotational speed N increases, and the urea water is supplied to the supply pipe 42. When the air Ar enters the supply pipe 42, the air Ar repeats alternatively between an elastic expansion and an elastic contraction in response to the pressure variation of the pipe pressure P. As a result, a variation quantity ΔN of the rotational speed N is greater than that when the air Ar does not enter the supply pipe 42. Since a supply quantity of the urea water supplied to the supply pipe 42 becomes unstable when the variation quantity ΔN of the rotational speed N becomes larger, the injection quantity of the urea water injected by the injector 50 to be supplied to the exhaust passage 31*a* becomes unstable.

In this case, it may determine whether the air Ar exists in the supply pipe 42 from the pressure variation of the pipe pressure P. However, for example, in the exhaust purification system 10 that controls the pipe pressure P to be constant by a pressure feedback control, since the variation quantity of the pipe pressure P is controlled to be in a predetermined range, it cannot determine whether the air Ar exists in the supply pipe 42 from the pipe pressure P.

According to the present embodiment, the pump control unit 70 executes an injection control processing to solve the above matters. In the injection control processing, the pump control unit 70 acquires the variation quantity ΔN of the rotational speed N in response to the injection of the injector 50 and determines whether the air Ar exists in the supply pipe 42 based on the variation quantity ΔN. In other words, the pump control unit 70 determines whether a mixing of the air Ar in the supply pipe 42 exists based on the variation quantity ΔN. Thus, an existence of an air mixing in the supply pipe 42 can be appropriately determined based on the variation quantity ΔN of the rotational speed N. The air mixing in the supply pipe 42 is the mixing of the air Ar in the supply pipe 42.

Figure 2:
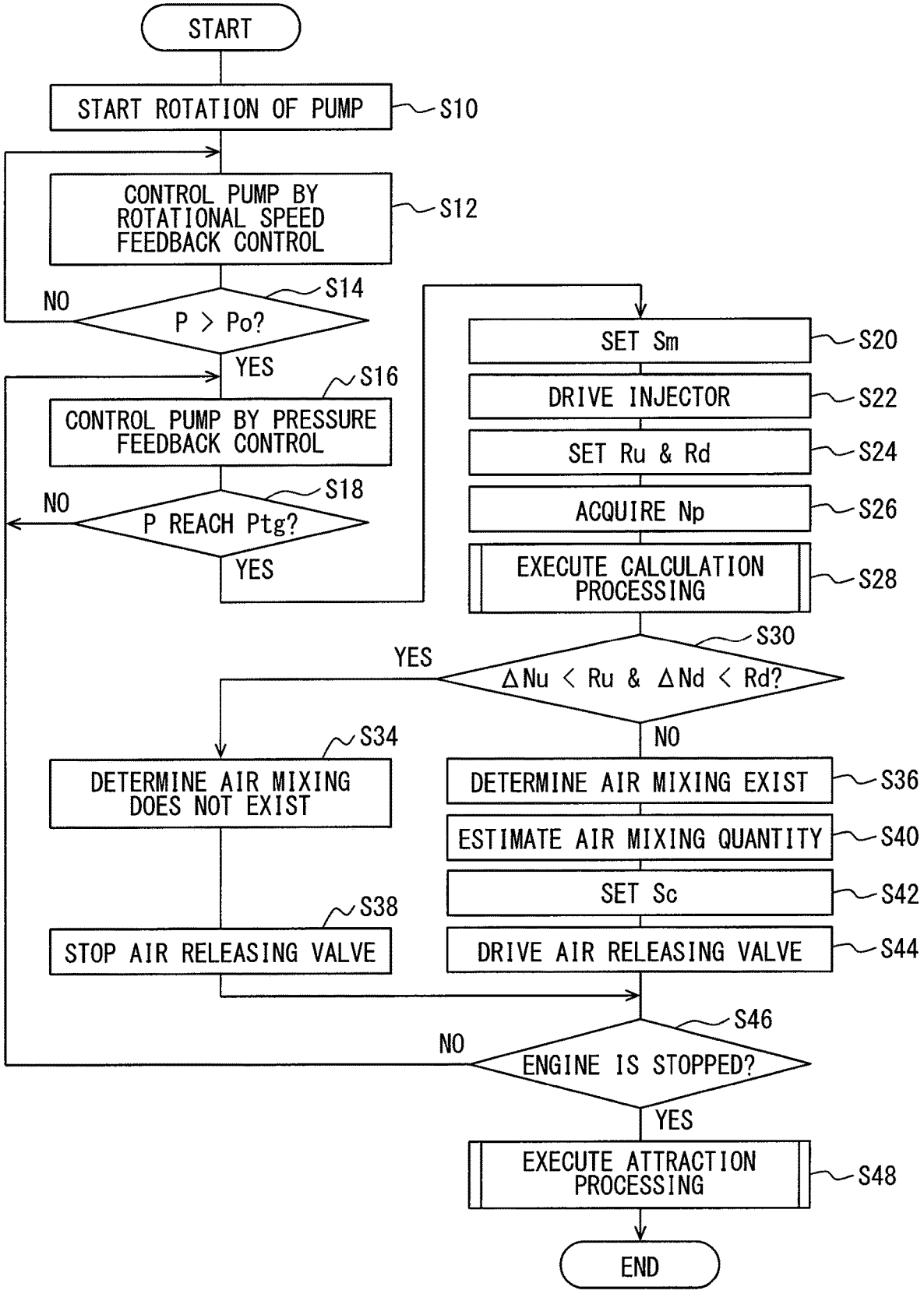
FIG. 2 is a flowchart showing an injection control processing according to a first embodiment of the present disclosure.

FIG. 2 is a flowchart of the injection control processing according to the present embodiment. The pump control unit 70 executes the injection control processing when the engine 30 is operating.

When the engine 30 starts, that is, when an ignition switch of the vehicle where the engine 30 is mounted to is turned on, the pump control unit 70 starts the injection control processing. When the pump control unit 70 starts the injection control processing, at S10, the pump control unit 70 fully opens the injector 50 and energizes the pump 44 to start a rotational drive of the pump 44 in a normal rotational direction. Thus, a supply of the urea water to the supply pipe 42 starts. When the injection control processing starts, the air releasing valve 60 functions as the check valve without receiving the control signal Sc.

Figure 6:
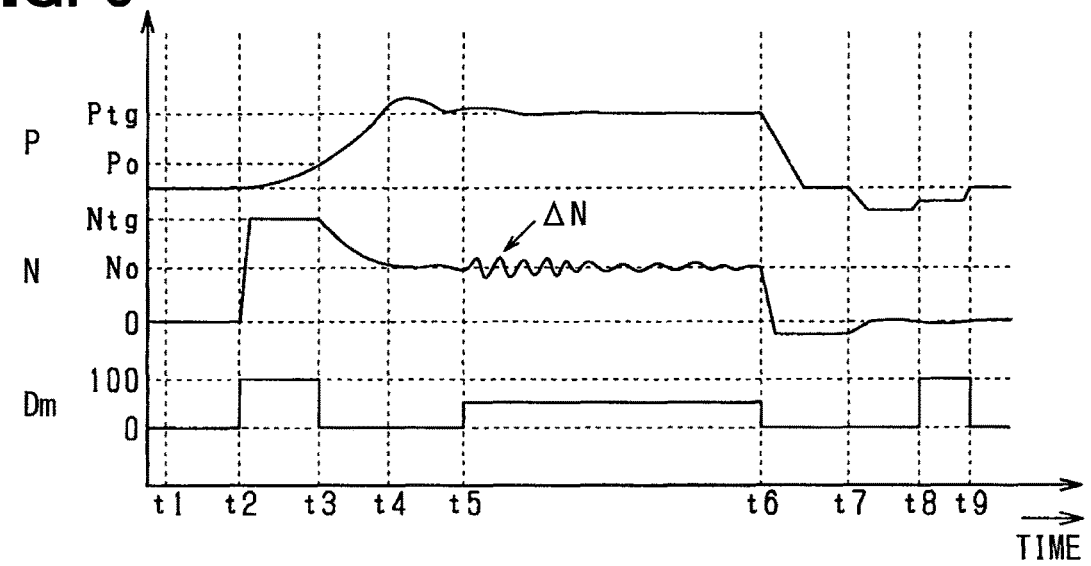
FIG. 6 is a graph showing a rotational speed of a pump in the injection control processing with time.

At S12, the pump control unit 70 executes a rotational speed feedback control to control a drive of the pump 44, so as to control the rotational speed N detected by the rotation detection unit 46 to be a target rotational speed Ntg that is predetermined as shown in FIG. 6. The target rotational speed Ntg is a maximum rotational speed of the pump 44.

At S14, the pump control unit 70 determines whether the pipe pressure P reaches a reference pressure Po as shown in FIG. 6. The reference pressure Po is set to a pressure where the urea water supplied to the supply pipe 42 reaches a position in the vicinity of the injector 50. When the pump control unit 70 determines a negative determination at S14, the pump control unit 70 returns to S12. When the pump control unit 70 determines a positive determination at S14, the pump control unit 70 closes the injector 50 and proceeds to S16. Thus, it is suppressed that a part of the urea water filled in the supply pipe 42 is leaked to the exhaust pipe 31 and the urea water educes to the exhaust pipe 31.

At S16, the pump control unit 70 executes the pressure feedback control to control the drive of the pump 44, so as to control the pipe pressure P detected by the pressure detection unit 48 to be a target pressure Ptg that is predetermined as shown in FIG. 6. The target pressure Ptg is the pipe pressure P when the injector 50 is in an injection state. The target pressure Ptg is greater than the reference pressure Po. According to the present embodiment, processing at S16 is equivalent to a feedback control unit.

At S18, the pump control unit 70 determines whether the pipe pressure P reaches the target pressure Ptg. When the pipe pressure P is in a range which is predetermined by using the target pressure Ptg as a center value for a predetermined time period, the pump control unit 70 determines that the pipe pressure P reaches the target pressure Ptg. When the pump control unit 70 determines a negative determination at S18, the pump control unit 70 returns to S16. When the pump control unit 70 determines a positive determination at S18, the pump control unit 70 executes an acquisition processing to acquire the variation quantity ΔN of the rotational speed N at S20, S22, S24, S26 and S28.

In the acquisition processing, at S20, the pump control unit 70 sets the drive signal Sm.

Figure 7:
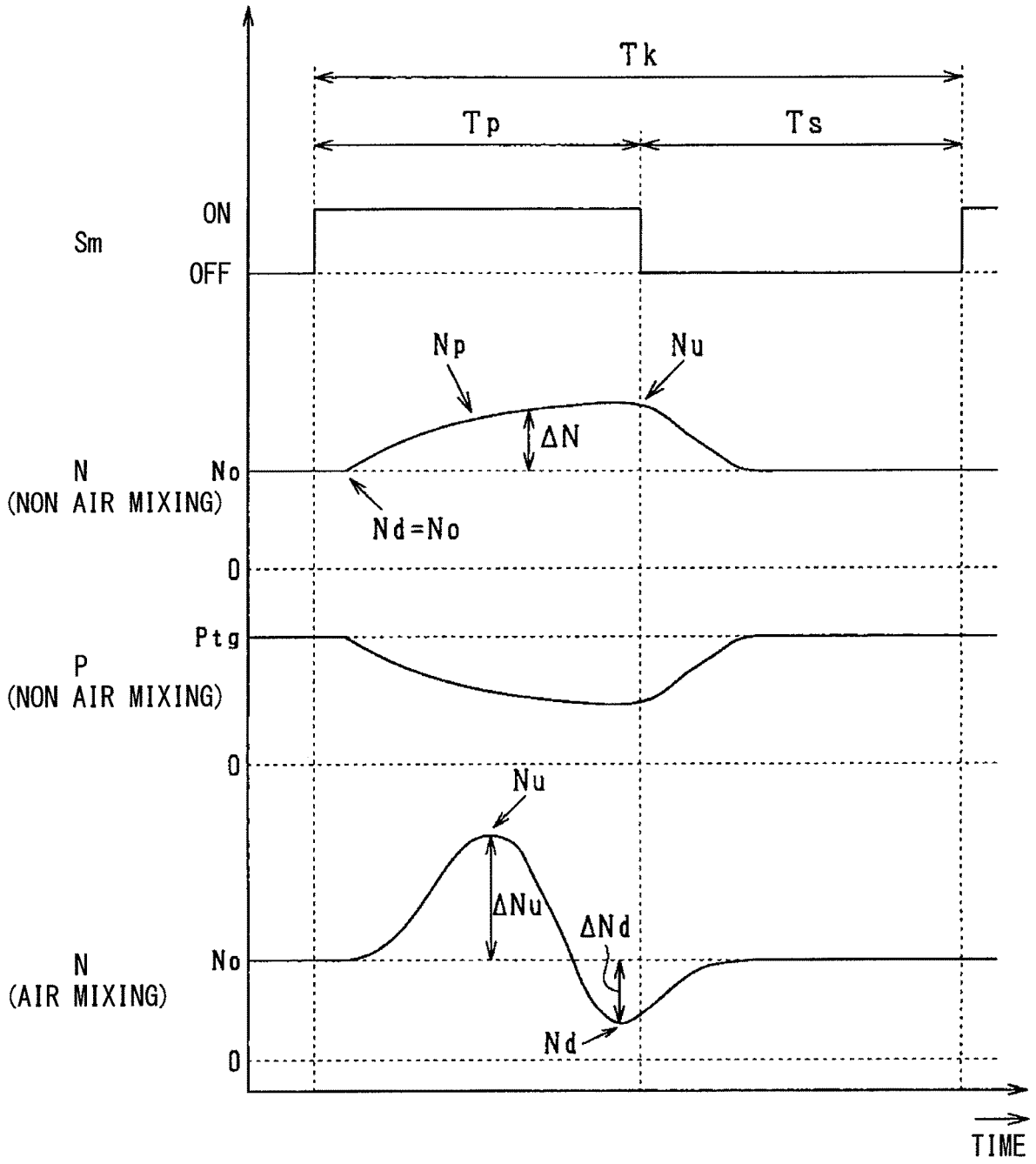
FIG. 7 is a graph showing the rotational speed of the pump in response to an injection of an injector with time.

The drive signal Sm is a signal including two values that are an on voltage and an off voltage. When the drive signal Sm becomes the off voltage, the injector 50 is closed, and the injection of the urea water caused by the injector 50 is stopped. According to the present embodiment, a time period where the drive signal Sm becomes the off voltage is referred to as an injection stop time period Ts as shown in FIG. 7. When the drive signal Sm becomes the on voltage, the injector 50 is opened, and the injector 50 injects the urea water. According to the present embodiment, a time period where the drive signal Sm becomes the on voltage is referred to as an injection time period Tp.

The drive signal Sm is switched between the on voltage and the off voltage at a normal cycle Tk that is predetermined. The pump control unit 70 can variably control a duty ratio Dm that is an injection duty ratio Dm. The injection duty ratio Dm is a value obtained by dividing the injection time period Tp by the normal cycle Tk. The injection duty ratio Dm is proportional to the injection quantity Q injected by the injector 50 per unit time. According to the present embodiment, the injection duty ratio Dm is equivalent to the injection quantity per unit time. According to the present embodiment, the normal cycle Tk is set to 2 Hz.

The pump control unit 70 calculates the injection quantity Q in the injector 50 according to an operation state of the engine 30 at a present time such as a load and a rotational speed. The pump control unit 70 sets the drive signal Sm by setting the injection duty ratio Dm which achieves the injection quantity Q while considering a temperature of the SCR catalyst 33 acquired by a temperature sensor that is not shown. At S22, the pump control unit 70 transmits the drive signal Sm set at S20 to the injector 50 to drive the injector 50.

At S24, the pump control unit 70 sets an increasing threshold Ru and a decreasing threshold Rd which are used to determine the air mixing. The increasing threshold Ru is a minimum value of the variation quantity of the rotational speed N increasing in response to the air Ar entered the supply pipe 42. In this case, the variation quantity is an increasing variation quantity. The decreasing threshold Rd is a minimum value of the variation quantity of the rotational speed N decreasing in response to the air Ar entered the supply pipe 42. In this case, the variation quantity is a decreasing variation quantity. In other words, the increasing threshold Ru and the decreasing threshold Rd correlates to the injection of the injector 50. Thus, the pump control unit 70 sets the increasing threshold Ru and the decreasing threshold Rd according to the injection duty ratio Dm set at S20 and proceeds to S26. According to the present embodiment, processing at S24 is equivalent to a setting unit.

At S26, the pump control unit 70 acquires an injection rotational speed Np that is the rotational speed N in the injection time period Tp by using the rotation detection unit 46 as shown in FIG. 7. Specifically, the pump control unit 70 acquires the injection rotational speed Np as a current value of an energization current flowing through the pump 44 when the pump 44 is energized. At S28, the pump control unit 70 executes a calculation processing to calculate a rotational variation parameter indicating a variation of the injection rotational speed Np. According to the present embodiment, the current value of the energization current flowing through the pump 44 when the pump 44 is energized is equivalent to a correlation value.

In the calculation processing, first, the pump control unit 70 acquires a reference rotational speed No in a start of the injection time period Tp as shown in FIG. 7. According to the present embodiment, the reference rotational speed No is less than the target rotational speed Ntg. Next, the pump control unit 70 acquires a maximum rotational speed Nu and a minimum rotational speed Nd of the injection rotational speed Np.

The pump control unit 70 calculates an absolute value of a difference between the maximum rotational speed Nu and the reference rotational speed No, and then acquires the absolute value as an increasing variation quantity ΔNu. The pump control unit 70 calculates an absolute value of a difference between the minimum rotational speed Nd and the reference rotational speed No, and then acquires the absolute value as a decreasing variation quantity ΔNd. According to the present embodiment, the increasing variation quantity ΔNu and the decreasing variation quantity ΔNd are equivalent to the rotational variation parameter, and processing at S28 is equivalent to an acquisition unit.

At S30, the pump control unit 70 compares the increasing variation quantity ΔNu acquired at S28 with the increasing threshold Ru set at S24 and compares the decreasing variation quantity ΔNd acquired at S28 with the decreasing threshold Rd set at S24.

When the increasing variation quantity ΔNu is less than the increasing threshold Ru and the decreasing variation quantity ΔNd is less than the decreasing threshold Rd, the pump control unit 70 determines a positive determination. When the pump control unit 70 determines the positive determination at S30, the pump control unit 70 proceeds to S34. At S34, the pump control unit 70 determines that the air does not enter the supply pipe 42. In other words, the pump control unit 70 determines that the air mixing does not exist in the supply pipe 42.

When the increasing variation quantity ΔNu is greater than the increasing threshold Ru and the decreasing variation quantity ΔNd is greater than the decreasing threshold Rd, the pump control unit 70 determines a negative determination. When the pump control unit 70 determines the negative determination at S30, the pump control unit 70 proceeds to S36. At S36, the pump control unit 70 determines that the air enters the supply pipe 42. In other words, the pump control unit 70 determines that the air mixing exists in the supply pipe 42. The pump control unit 70 determines whether the air mixing exists in the supply pipe 42 based on the rotational variation parameter, more specifically, based on a comparison result of the rotational variation parameter and the thresholds Ru and Rd. According to the present embodiment, processing at S30 is equivalent to a determination unit.

When the pump control unit 70 determines that the air does not enter the supply pipe 42 at S34, the pump control unit 70 proceeds to S38. At S38, the pump control unit 70 causes the air releasing valve 60 to stop. In other words, the pump control unit 70 maintains a state where the control signal Sc is not transmitted to the air releasing valve 60.

When the pump control unit 70 determines that the air enters the supply pipe 42 at S36, the pump control unit 70 executes a removing processing to remove the air entered the supply pipe 42 at S40, S42 and S44.

Figure 3:
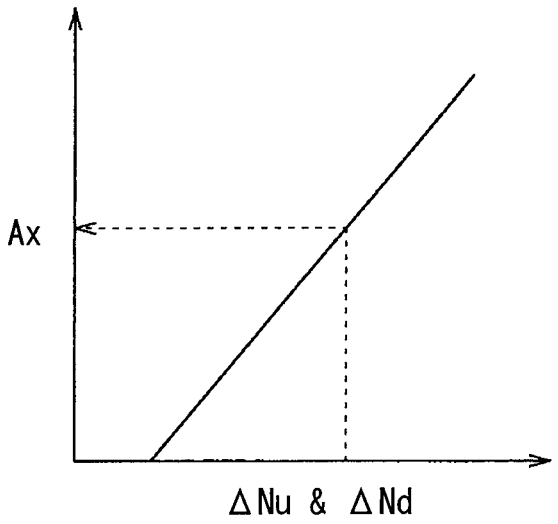
FIG. 3 is a graph showing a relationship between a variation quantity of an injection rotational speed and an air mixing quantity.

In the removing processing, first, at S40, the pump control unit 70 estimates an air mixing quantity Ax in the supply pipe 42. As shown in FIG. 3, the pump control unit 70 stores a first conversion table indicating a relation between the variation quantities ΔNu, ΔNd of the injection rotational speed Np and the air mixing quantity Ax. The first conversion table has a relation where the air mixing quantity Ax increases in accordance with an increase in variation quantities ΔNu, ΔNd of the injection rotational speed Np. The pump control unit 70 converts the larger one of the increasing variation quantity ΔNu and the decreasing variation quantity ΔNd acquired at S28 to the air mixing quantity Ax by using the first conversion table, to estimate the air mixing quantity Ax. In other words, the pump control unit 70 estimates the air mixing quantity Ax based on the rotational variation parameter. According to the present embodiment, processing at S40 is equivalent to an estimation unit.

Next, at S42, the pump control unit 70 sets the control signal Sc.

The control signal Sc is a signal including two values that are an on voltage and an off voltage. When the control signal Sc becomes the off voltage, the air releasing valve 60 is closed, and a returning of the urea water to the tank 40 caused by the air releasing valve 60 is stopped. When the control signal Sc becomes the on voltage, the air releasing valve 60 is opened, and the urea water and the air Ar are returned to the tank 40 through the air releasing valve 60.

The control signal Sc, similar to the drive signal Sm, is switched between the on voltage and the off voltage at the normal cycle Tk. The pump control unit 70 can variably control a duty ratio Dc that is a collection duty ratio Dc. The collection duty ratio Dc is a value obtained by dividing a time period where the control signal Sc becomes the on voltage by the normal cycle Tk. The collection duty ratio Dc is proportional to an air releasing quantity that is a quantity of the air Ar returned to the tank 40 through the air releasing valve 60 per unit time. According to the present embodiment, the collection duty ratio Dc is equivalent to the air releasing quantity per unit time.

Figure 4:
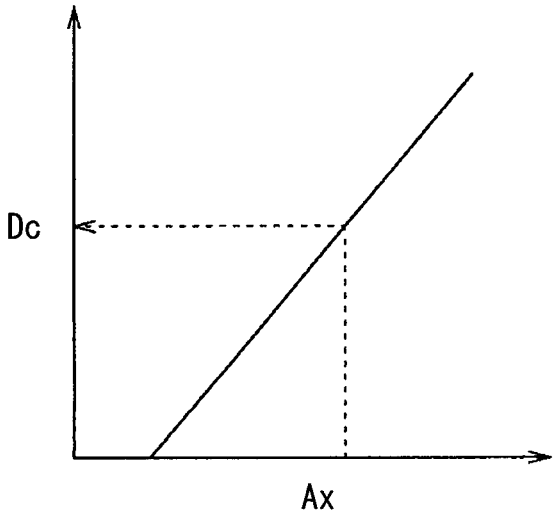
FIG. 4 is a graph showing a relationship between the air mixing quantity and a collection duty ratio.

As shown in FIG. 4, the pump control unit 70 stores a second conversion table indicating a relation between the air mixing quantity Ax and the collection duty ratio Dc. The second conversion table has a relation where the collection duty ration Dc increases in accordance with an increase in air mixing quantity Ax. The pump control unit 70 converts the air mixing quantity Ax estimated at S40 to the collection duty ratio Dc by using the second conversion table, to set the control signal Sc. In other words, the pump control unit 70 sets the collection duty ratio Dc based on the air mixing quantity Ax. Next, at S44, the pump control unit 70 outputs the control signal Sc set at S20 to the air releasing valve 60 to drive the air releasing valve 60. According to the present embodiment, processing at S42 is equivalent to a control unit.

In the second conversion table, the collection duty ratio Dc is set to increase in accordance with an increase in air mixing quantity Ax, and a minimum value of the collection duty ratio Dc is set to be greater than a maximum value of a check duty ratio Dr that is a duty ratio Dr of the air releasing valve 60 which functions as the check valve. Thus, since the collection duty ratio Dc is set by using the second conversion table, the collection duty ratio Dc is set to be greater than the check duty ratio Dr. In other words, the duty ratio of the air releasing valve 60 when the pump control unit 70 determines that the air enters the supply pipe 42 is controlled to be greater than the duty ratio of the air releasing valve 60 when the pump control unit 70 determines that the air does not enter the supply pipe 42, At S38, the pump control unit 70 stops the air releasing valve 60 for a predetermined time period and then proceeds to S46. At S44, the pump control unit 70 drives the air releasing valve 60 for a predetermined time period and then proceeds to S46. At S46, the pump control unit 70 determines whether the engine 30 is stopped. When the ignition switch of the vehicle where the engine 30 is mounted to is still turned on, the pump control unit 70 determines a negative determination at S46 and returns to S16.

When the ignition switch of the vehicle where the engine 30 is mounted to is turned off, the pump control unit 70 determines a positive determination at S46 and proceeds to S48. At S48, the pump control unit 70 reverses a rotation of the pump 44, executes an attraction processing to attract the urea water in the supply pipe 42 to the tank 40, and terminates the injection control processing.

Figure 5A:
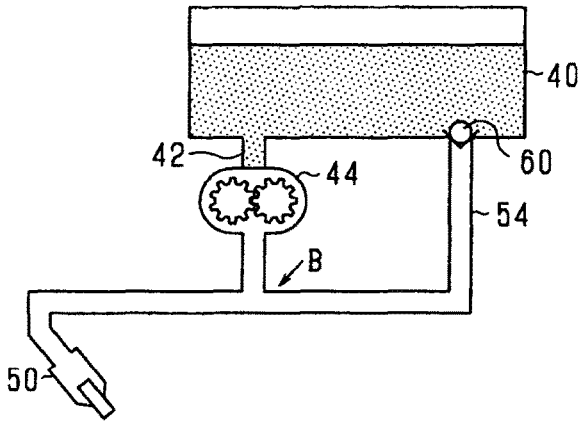
FIGS. 5A, 5B, 5C and 5D are diagrams showing a urea water in the injection control processing with time.
Figure 5B:
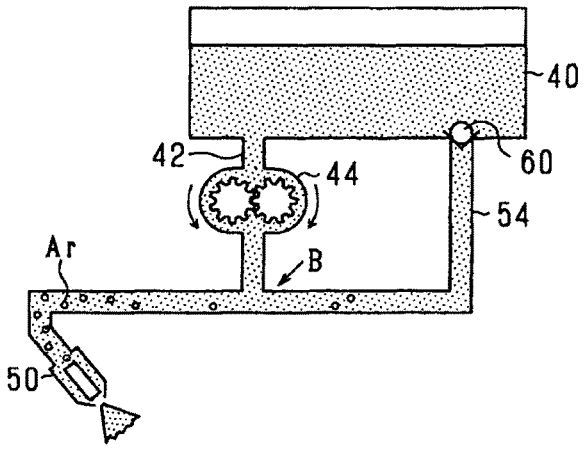
Figure 5C:
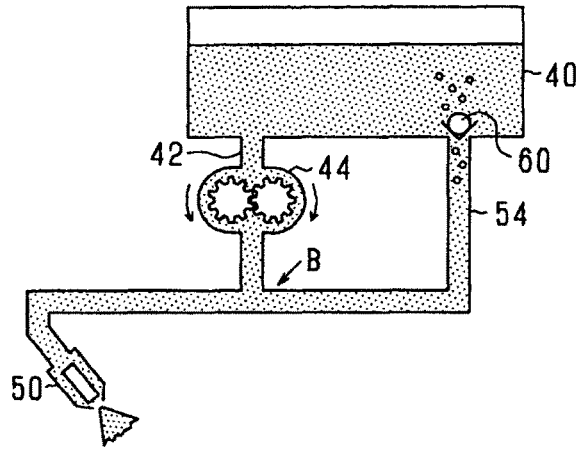
Figure 5D:
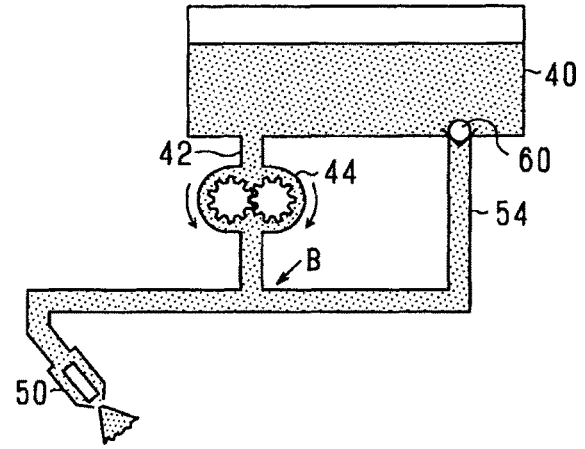

FIGS. 5A, 5B, 5C, 5D and 6 show an example of the injection control processing. Specifically, FIGS. 5A, 5B, 5C and 5D show the urea water in the injection control processing with time. FIG. 5A shows the reducing-agent injection system 20 in a start of the injection control processing, FIG. 5B shows the reducing-agent injection system 20 after the urea water is filled, FIG. 5C shows the reducing-agent injection system 20 in the removing processing, and FIG. 5D shows the reducing-agent injection system 20 after the removing processing.

FIG. 6 shows the rotational speed N in the injection control processing with time. FIG. 6 shows the pipe pressure P, the rotational speed N and the injection duty ratio Dm with time. As shown in FIG. 6, a pulsation caused by a disturb other than the injection of the injector 50 and an elastic deformation of the air Ar is removed from the rotational speed N and the pipe pressure P in the supply pipe 42. FIGS. 7 and 8 show similar matters.

As shown in FIG. 5A, in the start of the injection control processing, a region in the supply pipe 42 downstream of the pump 44 and the air releasing pipe 54 are filled with surplus air. As shown in FIG. 6, when the engine 30 starts while the ignition switch of the vehicle is turned on at a time point t1, the injection control processing starts, the pump 44 is caused to be in the normal rotation, and the supply pipe 42 and the air releasing pipe 54 are filled with the urea water, at a time point t2 (S10).

Specifically, the pump control unit 70 fills the urea water by the rotational speed feedback control in a state where the injector 50 is opened, at the time point t2 (S12). Then, when the pipe pressure P reaches the reference pressure Po (S14: Positive determination), the pump control unit 70 fills the urea water by the pressure feedback control in a state where the injector 50 is closed at a time point t3 (S16). Then, when the pipe pressure P reaches the target pressure Ptg (S16; Positive determination), the pump control unit 70 terminates a filling of the urea water to the supply pipe 42 and the air releasing pipe 54 at a time point t4.

As shown in FIG. 5B, the air Ar enters the supply pipe 42 after the filling of the urea water. Thus, when the injection of the urea water caused by the injector 50 starts while an output of the drive signal Sm starts, the variation quantity ΔN of the rotational speed Np becomes large, at a time point t5.

FIG. 7 shows the rotational speed N in response to the injection of the injector 50 with time. FIG. 7 shows the drive signal Sm, the rotational speed N when the air Ar does not enter the supply pipe 42, the pipe pressure P when the air Ar does not enter the supply pipe 42 and the rotational speed N when the air Ar enters the supply pipe 42 with time.

As shown in FIG. 7, in the injection stop time period Ts, the rotational speed N is controlled to the reference rotational speed No by the pressure feedback control of the pump 44. In the injection time period Tp, the pipe pressure P decreases from the target pressure Ptg in response to the injection. To correct a pressure decrease in response to the injection, a urea water quantity that is a quantity of the urea water discharged from the pump 44 by the pressure feedback control is increased, and the injection rotational speed Np increases in response to an increasing of the urea water quantity. The variation quantity ΔN of the rotational speed N is a variation of the injection rotational speed Np from the reference rotational speed No in response to the injection.

As shown in FIG. 7, when the air Ar does not enter the supply pipe 42, the injection rotational speed Np monotonically increases in response to the injection of the injector 50. When the injection rotational speed Np reaches the maximum rotational speed Nu, the injection rotational speed Np monotonically decreases to return to the reference rotational speed No. Thus, the minimum rotational speed Nd is substantially equal to the reference rotational speed No.

As shown in FIG. 7, when the air Ar enters the supply pipe 42, the air Ar is elastically deformed by a variation of the pipe pressure P in response to the injection of the injector 50 and the injection rotational speed Np pulsates. As a result, the maximum rotational speed Nu becomes larger and the minimum rotational speed Nd becomes smaller, comparing a case where the air Ar enters the supply pipe 42 with a case where the air Ar does not enter the supply pipe 42. When the variation quantities ΔNu and ΔNd of the injection rotational speed Np calculated from the maximum rotational speed Nu and the minimum rotational speed Nd are greater than the thresholds Ru and Rd, respectively, the pump control unit 70 executes the removing processing (S40, S42 and S44).

As shown in FIG. 5C, in the removing processing, the control signal Sc is output and the air releasing valve 60 is driven in a state where the pump 44 is caused to be in the normal rotation. The collection duty ratio Dc of the control signal Sc is set based on the air mixing quantity Ax in the supply pipe 42 (S42).

FIG. 8 shows a setting procedure of the collection duty ratio Dc. FIG. 8 shows the drive signal Sm, the rotational speed N and the collection duty ratio Dc of the control signal Sc with time. Further, as show in FIG. 8, dashed lines F1 indicate a case where the air mixing quantity Ax is relatively small, and solid lines F2 indicate a case where the air mixing quantity Ax is relatively large.

As the dashed lines F1 shown in FIG. 8, when the air mixing quantity Ax is relatively small, the variation quantities ΔNu, ΔNd of the injection rotational speed Np become relatively small. When the variation quantities ΔNu, ΔNd of the injection rotational speed Np are relatively small, the pump control unit 70 determines that the air mixing quantity Ax is relatively small, and sets the collection duty ratio Dc of the control signal Sc to a first collection duty ratio Dc1. In this case, the first collection duty ratio Dc1 is greater than zero and is less than one.

As the solid lines F2 shown in FIG. 8, when the air mixing quantity Ax is relatively large, the variation quantities ΔNu, ΔNd of the injection rotational speed Np become relatively large. When the variation quantities ΔNu, ΔNd of the injection rotational speed Np are relatively large, the pump control unit 70 determines that the air mixing quantity Ax is relatively large, and sets the collection duty ratio Dc of the control signal Sc to a second collection duty ratio Dc2. In this case, the second collection duty ratio Dc2 is greater than the first collection duty ratio Dc1 and is less than one.

The control signal Sc including the collection duty ratio Dc set as above is output to the air releasing valve 60, and the air releasing valve 60 is driven. As a result, as shown in FIG. 5D, the air Ar entered the supply pipe 42 is removed appropriately.

Then, when the engine 30 is stopped while the ignition switch of the vehicle is turned off, the pump control unit 70 stops the injection of the urea water caused by the injector 50 by stopping the output of the drive signal Sm and executes the attraction processing (S48), at a time point t6. In the attraction processing, the pump control unit 70 causes reverse the rotation of the pump 44.

Then, the pump control unit 70 stops reversing the rotation of the pump 44 at a time point t7, and opens the injector 50 at a time point t8. Thus, the pipe pressure P decreased by the inverse rotation of the pump 44 is returned to the atmospheric pressure. Then, the pump control unit 70 closes the injector 50 and terminates the injection control processing, at a time point t9. As shown in FIG. 5A, the urea water in the supply pipe 42 is returned to the tank 40.

According to the present embodiment, following effects can be achieved.

The variation quantities ΔNu, ΔNd of the injection rotational speed Np of the pump 44 generated in response to the injection of the injector 50 and the air mixing quantity Ax in the supply pipe 42 have a relation. Thus, according to the present embodiment, it can be appropriately determine whether the air mixing exists in the supply pipe 42 based on the variation quantities ΔNu, ΔNd of the injection rotational speed Np.

The pipe pressure P also varies in response to the injection of the injector 50. Since the variation quantity of the pipe pressure P is controlled to be in the predetermined range including the target pressure Ptg as a center when the pump 44 is controlled by the pressure feedback control, it cannot be appropriately determine whether the air mixing exists in the supply pipe 42 based on the pipe pressure P. According to the present embodiment, since it is determined whether the air mixing exists in the supply pipe 42 based on the variation quantities ΔNu, ΔNd of the injection rotational speed Np when the pump 44 is controlled by the pressure feedback control, it can be appropriately determined whether the air mixing exists in the supply pipe 42.

According to the present embodiment, since the variation quantities ΔNu, ΔNd of the injection rotational speed Np and the injection duty ratio Dm of the injector 50 have a relation, the thresholds Ru, Rd are set corresponding to the injection duty ratio Dm. Thus, it can be determined whether the air mixing exists in the supply pipe 42 based on a comparison result of the variation quantities ΔNu, ΔNd of the injection rotational speed Np and the thresholds Ru, Rd, with a high precision.

According to the present embodiment, the collection duty ratio Dc of the air releasing valve 60 when it is determined that the air Ar enters the supply pipe 42 is greater than the check duty ratio Dr when the it is determined that the air Ar does not enter the supply pipe 42. Thus, comparing a case where the collection duty ratio Dc is greater than the check duty ratio Dr with a case where the collection duty ratio Dc is less than the check duty ratio Dr, the air Ar entered the supply pipe 42 can be returned to the tank 40 through the air releasing valve 60 at an early stage.

According to the present embodiment, the air mixing quantity Ax in the supply pipe 42 is estimated by using the variation quantities ΔNu, ΔNd of the injection rotational speed Np, and the collection duty ratio Dc is set based on the air mixing ratio Ax that is estimated. It can be suppressed that the air releasing valve 60 is insufficiently opened even though the air mixing quantity Ax that is estimated is relatively large. Thus, the air Ar entered the supply pipe 42 can be return to the tank 40 through the air releasing valve 60 at an early stage. Further, it can be suppressed that the air releasing valve 60 is excessively opened even though the air mixing quantity Ax that is estimated is relatively small. Thus, a power necessary in the removing processing which is a drive power of the air releasing valve 60 or a drive power of the pump 44 in response to an increasing of the injection rotational speed Np caused by an opening of the air releasing valve 60 can be suppressed.

According to the present embodiment, the air Ar entered the supply pipe 42 is returned to the tank 40 by controlling the opening and a closing of the air releasing valve 60 functioning as the check valve. Thus, comparing with a constitution where an on-off valve that returns the air Ar entered the supply pipe 42 to the tank 40 and a pipe to which only the on-off valve is attached are provided individually from the air releasing valve 60 that functions as the check valve and the air releasing pipe 54 to which the air releasing valve 60 is attached, the constitution of the reducing-agent injection system 20 can be simplified.

Second Embodiment

The pump control unit 70 according to a second embodiment of the present disclosure will be described referring to FIG. 9. The pump control unit 70 according to the second embodiment is different from the pump control unit 70 according to the first embodiment in the injection control processing. Hereafter, the injection control processing according to the second embodiment will be described.

Figure 9:
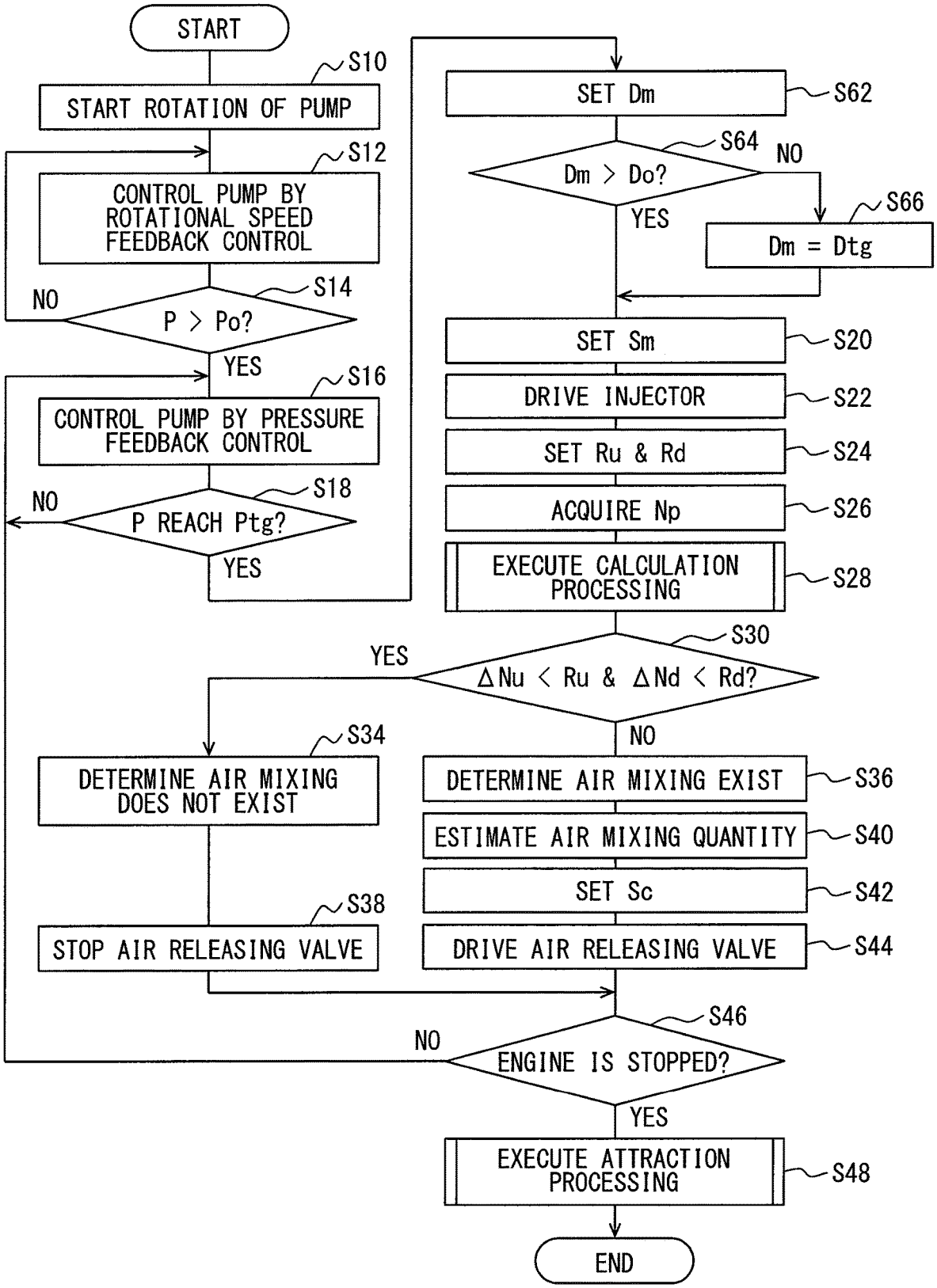
FIG. 9 is a flowchart showing the injection control processing according to a second embodiment of the present disclosure.

As shown in FIG. 9, the injection control processing according to the second embodiment is different from the injection control processing according to the first embodiment in a setting of the drive signal Sm. In addition, the substantially same processings as the first embodiment are indicated with the same reference numeral and the same description will be omitted.

When the pump control unit 70 determines a positive determination at S18, the pump control unit 70 proceeds to S62. At S62, the pump control unit 70 sets the injection duty ratio Dm according to the operation state of the engine 30. At S64, the pump control unit 70 determines whether the injection duty ratio Dm that is set is greater than a reference duty ratio Do that is predetermined. The reference duty ratio Do is a minimum injection duty ratio Dm used to appropriately determine whether the air mixing exists in the supply pipe 42 by using the variation quantities ΔNu, ΔNd of the injection rotational speed Np. According to the present embodiment, the reference duty ratio Do is set to 50%. Further, according to the present embodiment, the reference duty ratio Do is equivalent to a reference injection quantity.

When the pump control unit 70 determines a positive determination at S64, the pump control unit 70 proceeds to S20. At S20, the pump control unit 70 sets the drive signal Sm by using the injection duty ratio Dm set at S62. Then, at S24, the pump control unit 70 sets the thresholds Ru, Rd corresponding to the injection duty ratio Dm that is set at S62.

When the pump control unit 70 determines a negative determination at S64, the pump control unit 70 proceeds to S66. At S66, the pump control unit 70 resets injection duty ratio Dm to a target duty ratio Dtg that is predetermined and is greater than the reference duty ratio Do. The target duty ratio Dtg is the injection duty ratio Dm where the variation quantities ΔNu, ΔNd of the injection rotational speed Np is sufficiently generated to appropriately determine whether the air mixing exists in the supply pipe 42. According to the present embodiment, the target duty ratio Dtg is set to 80%. In other words, when the injection duty ratio Dm is less than the reference duty ratio Do, the pump control unit 70 sets the injection duty ratio Dm to be greater than the reference duty ratio Do.

When the pump control unit 70 sets the injection duty ratio Dm at S66, the pump control unit 70 proceeds to S20. At S20, the pump control unit 70 sets the drive signal Sm by using the injection duty ratio Dm set at S66. Then, at S24, the pump control unit 70 sets the thresholds Ru, Rd corresponding to the injection duty ratio Dm set at S66.

As the above description, according to the present embodiment, the injection duty ratio Dm according to the operation state of the engine 30 is compared with the reference duty ratio Do. When the injection duty ratio Dm is less than the reference duty ratio Do, the injection duty ratio Dm is set to the target duty ratio Dtg that is greater than the reference duty ratio Do.

The injection duty ratio Dm and the variation quantity ΔN of the injection rotational speed Np have a relation where the variation quantity ΔN of the injection rotational speed Np increases in accordance with an increase in injection duty ratio Dm. Thus, when the injection duty ratio Dm is less than the reference duty ratio Do, it cannot determine with a high precision on whether the air mixing exists in the supply pipe 42 by using the variation quantities ΔNu, ΔNd of the injection rotational speed Np.

According the present embodiment, when the injection duty ratio Dm according to the operation state of the engine 30 is less than the reference duty ratio Do, the injection duty ratio Dm is set to the target duty ratio Dtg that is greater than the reference duty ratio Do. Thus, it can be determined with a high precision on whether the air mixing exists in the supply pipe 42 even though the injection duty ratio Dm according to the operation state of the engine 30 is less than the reference duty ratio Do.

The present disclosure is not limited to the above embodiments, and may be applied to the followings, for example.

The reducing agent that is in a liquid state is not limited to the urea water. For example, a compound obtained from ammonia other than the urea water may be injected as the reducing agent.

The increasing variation quantity ΔNu and the decreasing variation quantity ΔNd are calculated as the rotational variation parameter, and it is not limited. For example, one of the increasing variation quantity ΔNu and the decreasing variation quantity ΔNd may be calculated as the rotational variation parameter. Alternatively, the increasing variation quantity ΔNu, the decreasing variation quantity ΔNd, and an absolute value of a difference between the maximum rotational speed Nu and the minimum rotational speed Nd of the injection rotational speed Np may be calculated as the rotational variation parameter. Alternatively, the absolute value of the difference between the maximum rotational speed Nu and the minimum rotational speed Nd of the injection rotational speed Np may be calculated as the rotational variation parameter, instead of the increasing variation quantity ΔNu and the decreasing variation quantity ΔNd. In the above cases, the reference rotational speed No may be not acquired.

Alternatively, the increasing variation quantity ΔNu, the decreasing variation quantity ΔNd, and a pulsation time period where the injection rotational speed Np pulsates may be acquired as the rotational variation parameter. Alternatively, the pulsation time period where the injection rotational speed Np pulsates may be acquired as the rotational variation parameter, instead of the increasing variation quantity ΔNu and the decreasing variation quantity ΔNd. When the air mixing quantity Ax in the supply pipe 42 is relatively large, a time period where the air Ar entered the supply pipe 42 is released becomes longer, and the pulsation time period becomes longer. In other words, the pulsation time period and the air mixing quantity Ax have a relation where the air mixing quantity Ax increases in accordance with an increase in pulsation time period. Thus, it can be determined whether the air mixing exists in the supply pipe 42 based on the pulsation time period where the injection rotational speed Np pulsates.

The injection quantity per unit time is adjusted by the injection duty ratio Dm, and it is not limited. For example, an opening degree of the injector 50 indicating a releasing level of the injector 50 may be adjusted. The air releasing quantity per unit time is adjusted by the collection duty ratio Dc, and it is not limited. For example, an opening degree of the air releasing valve 60 indicating a releasing level of the air releasing valve 60 may be adjusted.

The pump control unit 70 may continuously acquire the variation quantities ΔNu, ΔNd of the injection rotational speed Np in a time period where the air releasing valve 60 is being driven. When the variation quantities ΔNu, ΔNd of the injection rotational speed Np are less than the thresholds Ru, Rd, respectively, the air releasing valve 60 may be stopped in response to the air Ar entered the supply pipe 42 which is returned to the tank 40 by a drive of the air releasing valve 60.

The present disclosure has been described with reference to the examples, but the present disclosure is not limited to the examples or the structures. The present disclosure includes various modification examples and modifications within the same range. In addition, while the various combinations and configurations, which are preferred, other combinations and configurations, including more, less or only a single element, are also within the spirit and scope of the present disclosure.

What is claimed is:

1. An injection controller configured to be applied to an exhaust purification system that includes (a) an injector located in an exhaust passage of an internal combustion engine and injects to supply a reducing agent in a liquid state to a NOx purification catalyst purifying NOx in an exhaust gas, and (b) a pump that pressurizes and pumps the reducing agent to the injector through a reducing-agent passage, the injection controller comprising:

a memory; and a processor operatively coupled to the memory, the memory and the processor configured to cause the injection controller to:

acquire a variation quantity of a rotational speed of the pump caused in response to an injection of the injector, or acquire a correlation value that includes a current value of an energization current flowing through the pump when the pump is energized and is correlative to the variation quantity, as a rotational variation parameter;

determine whether an air mixing exists in the reducing-agent passage based on the rotational variation parameter; and control an air releasing quantity of an air releasing valve based on determining whether the air mixing exists in the reducing-agent passage.

2. The injection controller according to claim 1, wherein the memory and the processor further causing the injection controller to:

set a threshold for determining the air mixing, according to an injection quantity of the injector per unit time; and determine whether the air mixing exists in the reducing-agent passage, based on a comparison result between the acquired rotational variation parameter and the set threshold.

3. The injection controller according to claim 2, wherein the exhaust purification system further includes a tank that stores the reducing agent, an air releasing passage that is connected with the reducing-agent passage and communicates with the tank, and the air releasing valve that is attached to the air releasing passage and opens and closes the air releasing passage, and wherein the memory and the processor further causing the injection controller to:

variably control the air releasing quantity per unit time; and control the air releasing quantity when determining that the air mixing existing in the reducing-agent passage to be greater than the air releasing quantity.

4. The injection controller according to claim 3, wherein the memory and the processor further causing the injection controller to:

estimate an air mixing quantity in the reducing-agent passage based on the acquired rotational variation parameter when determining that the air mixing exists in the reducing-agent passage; and set the air releasing quantity when determining that the air mixing exists in the reducing-agent passage, based on the estimated air mixing quantity.

5. The injection controller according to claim 2, wherein the memory and the processor further causing the injection controller to:

set the injection quantity per unit time, in response to an operation state of the internal combustion engine, to be greater than a reference injection quantity that is predetermined, when the injection quantity per unit time is less than the reference injection quantity; and set the threshold in response to the set injection quantity per unit time.

6. The injection controller according to claim 1, wherein the exhaust purification system further includes a pressure detection device configured to detect a pressure in the reducing-agent passage, and wherein the memory and the processor further causing the injection controller to:

execute a feedback control of a drive of the pump to control the pressure of the reducing agent detected by the pressure detection device in the injection of the injector to be a target pressure that is predetermined; and acquire the rotational variation parameter when the pressure in the reducing-agent passage is controlled to be the target pressure.

7. The injection controller according to claim 1, wherein the processor and the memory further causing the injection controller to determine that the air mixing exists in the reducing-agent passage in response to the rotational variation parameter becoming greater than an upper threshold and then becoming less than a lower threshold.

* * * * *